US008109661B2

(12) United States Patent
Chien et al.

(10) Patent No.: US 8,109,661 B2
(45) Date of Patent: Feb. 7, 2012

(54) ILLUMINATION APPARATUS AND HEAT DISSIPATION STRUCTURE THEREOF

(75) Inventors: Chao-Nan Chien, Hukou Township, Hsinchu County (TW); Shang-Hsuang Wu, Hukou Township, Hsinchu County (TW); Chih-Cheng Chou, Hukou Township, Hsinchu County (TW)

(73) Assignee: Young Green Energy Co., Hukou Township, Hsinchu County (TW)

( * ) Notice: Subject to any disclaimer, the term of this patent is extended or adjusted under 35 U.S.C. 154(b) by 159 days.

(21) Appl. No.: 12/662,860

(22) Filed: May 7, 2010

(65) Prior Publication Data

US 2010/0290237 A1 Nov. 18, 2010

(30) Foreign Application Priority Data

May 14, 2009 (TW) ..... 98115957 A

(51) Int. Cl.
*F21V 29/00* (2006.01)

(52) U.S. Cl. ..... 362/373; 362/431

(58) Field of Classification Search ..... 362/373, 362/294, 218, 431, 580
See application file for complete search history.

(56) References Cited

U.S. PATENT DOCUMENTS

| | | | | |
|---|---|---|---|---|
| 7,143,762 | B2 | 12/2006 | Harrison et al. | |
| 2010/0046225 | A1 * | 2/2010 | Zheng | 362/249.03 |
| 2010/0053966 | A1 * | 3/2010 | Tu et al. | 362/249.02 |

FOREIGN PATENT DOCUMENTS

| | | | |
|---|---|---|---|
| CN | 1807971 | A | 7/2006 |
| JP | 2006119288 | A | 5/2006 |
| TW | 201003289 | | 1/2010 |

OTHER PUBLICATIONS

English translation of Office Action issued by SIPO of P.R.C. on Aug. 24, 2011 of the corresponding Taiwanese application.

* cited by examiner

*Primary Examiner* — Laura Tso
(74) *Attorney, Agent, or Firm* — MH2 Technology Law Group, LLP

(57) ABSTRACT

An illumination apparatus includes a housing, a light source module, and a heat dissipation structure including heat sink fins, a shutter structure, and a variable element. The housing provides a bottom and an outlet disposed at one side of the bottom. The heat sink fins are disposed in the housing and thermal conductivity connected with the light source module. The shutter structure is disposed on the outlet and includes guiding plates, a connecting rod, and an operating element. Each of guiding plates is connected to the connecting rod. The operating element is disposed at one end of the connecting rod and provides an operating force for the connecting rod. The variable element is near the heat sink fins and connected with the connecting rod, the variable element is deformed to exert a force on the connecting rod when the variable element is heated.

19 Claims, 11 Drawing Sheets

ILLUMINATION APPARATUS AND HEAT DISSIPATION STRUCTURE THEREOF

CROSS-REFERENCE TO RELATED APPLICATION

This application claims the priority benefit of Taiwan application serial no. 98115957, filed on May 14, 2009.

BACKGROUND OF THE INVENTION

1. Field of the Invention

The invention generally relates to an illumination apparatus, and more particularly, to an illumination apparatus having a heat dissipation structure.

2. Description of Related Art

Most of the illumination apparatuses using on the street are high voltage sodium lamps and mercury lamps. However, the high voltage sodium lamp and the mercury lamp have disadvantages of high power cost and low endurance. With the development of the technology, the light emitting diode (LED) having advantages of high illumination, high endurance, and low power cost is used as the illumination apparatus of the light source to substitute the high voltage sodium lamp and the mercury lamp having disadvantage of high power cost and low endurance. However, the enduring temperature of the LED is 120□, and once the temperature of the LED is more than 120□, the life of the LED may be reduced quickly and the LED may be damaged. Therefore, solving the heat dissipation problem of the illumination apparatus using the LED is important.

In addition, the above-mentioned illumination apparatus is used in outdoor environment, so a dustproof problem is important. Please refer to FIG. 1, an illumination apparatus 100 includes a housing 110, a light source module (not described), and a plurality of heat dissipation fins 130.

The housing 110 has a heat dissipation substrate 115 and a plurality of outlets 116. The outlets 116 are disposed at one side of the housing 110. Referring to FIG. 2 at the same time, the light source module 120 is disposed on the bottom surface of the heat dissipation substrate 115. A plurality of the heat dissipation fins 130 are disposed in the housing 110 and located on the top surface of the heat dissipation substrate 115. The heat generated by the light source module 120 on the bottom surface of the heat dissipation substrate 115 is dissipated to the heat dissipation fins 130 on the top surface of the heat dissipation substrate 115 through the heat dissipation substrate 115, and the heat dissipation fins 130 make the heat be carried from the outlets 116 of the housing 110 to the outside of the hosing 110 of the illumination apparatus 100 through the gas convection.

However, if the openings of the outlets 116 provided by the housing 110 of the conventional illumination apparatus 100 are larger, the dustproof effect of the illumination apparatus 100 may be reduced, and the dust and other foreign material may enter the housing 110 through the outlets 116 and block up the gap between the heat dissipation fins 130 and result in bad heat dissipation effect of the illumination apparatus 100 and the damage of the light source module 120. If the openings of the outlets 116 are smaller, the heat stored in the housing 100 may dissipate ineffectively, and result in bad heat dissipation effect of the illumination apparatus 100 and the damage of the light source module 120. Therefore, how to make the openings of the outlets 116 of the illumination apparatus 100 big enough to dissipate heat and have dustproof effect are problems of the technological area to solve.

SUMMARY OF THE INVENTION

The invention provides an illumination apparatus having a heat dissipation structure to achieve heat dissipation and dustproof effect of the illumination apparatus.

Other objectives and advantages of the invention may be further understood by the disclosures of the invention.

To achieve at least one of the above-mentioned objectives or other objectives, an illumination apparatus of an embodiment of the invention includes a housing, a light source module, a plurality of heat sink fins, a shutter structure, and an variable element. The housing has a bottom and an outlet, and the outlet is disposed at one side of the bottom. The light source module is disposed on the bottom of the housing. A plurality of heat sink fins are disposed in the housing and thermal conductivity connected with the light source module. The shutter structure is disposed on the outlet and includes a plurality of guiding plates, a connecting rod, and an operating element, and each of the guiding plates is connected to the connecting rod. The operating element is disposed at one end of the connecting rod and provides an operating force for the connecting rod. The variable element is near the heat sink fins and connected to the connecting rod. The variable element is deformed to exert a force on the connecting rod when the variable element is heated.

A heat dissipation structure used in the above-mentioned illumination apparatus according to an embodiment of the invention includes the above-mentioned heat sink fins, the shutter structure, and the variable element.

In one embodiment, the illumination apparatus and the heat dissipation structure of the illumination apparatus further include a support. The support surrounds the variable element and is in the shape of a pipe or one end of the support is disposed on the bottom and another end of the support has a hook. The hook surrounds the variable element. The material of the support includes thermal conductivity.

In one embodiment, the illumination apparatus and the heat dissipation structure of the illumination apparatus further include a heat dissipation plate, and the heat dissipation plate is thermal conductivity connected between the heat sink fins and the light source module.

In one embodiment, the bottom is a heat dissipation surface of the housing.

In one embodiment, the shape of the variable element is a circular cylinder, a rectangular cylinder, a triangular cylinder or a spiral, and the material of the variable element is a shape memory alloy module.

In one embodiment, the operating element is an elastic spring, a resilient sheet or a counterweight block.

In one embodiment, the housing further includes a plurality of inlets, and the inlets are disposed at one side of the bottom of the housing and opposite to the outlet.

Comparing with the conventional technology, the embodiment of the invention provides a heat dissipation structure to control the open and close of the outlets of the illumination apparatus, to solve the problem that the outlets of the conventional illumination apparatus may hard to achieve the heat dissipation effect and dustproof effect.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
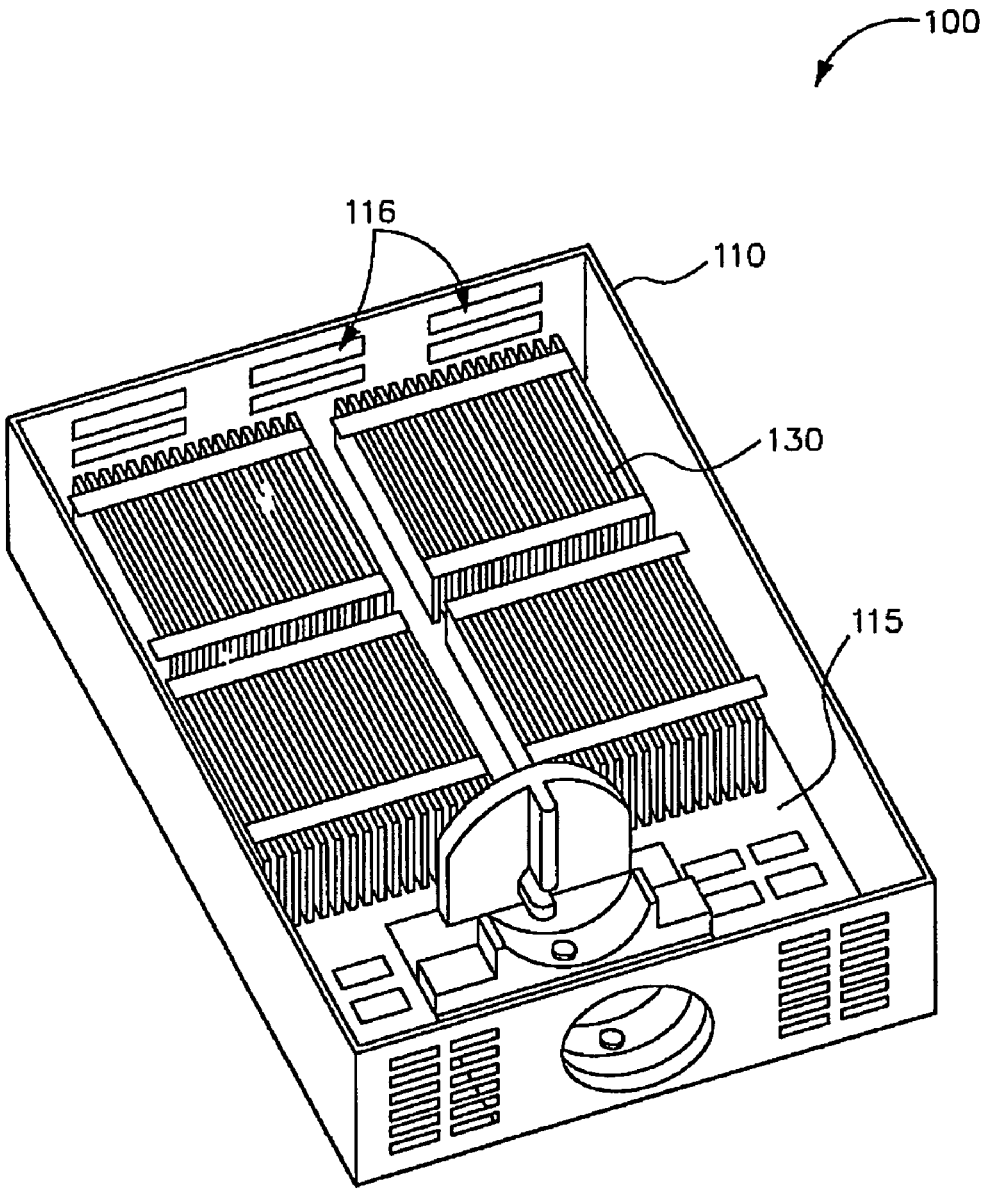
FIG. 1 (prior art)
FIG. 1 is a three dimensional view of a conventional illumination apparatus.
Figure 2:
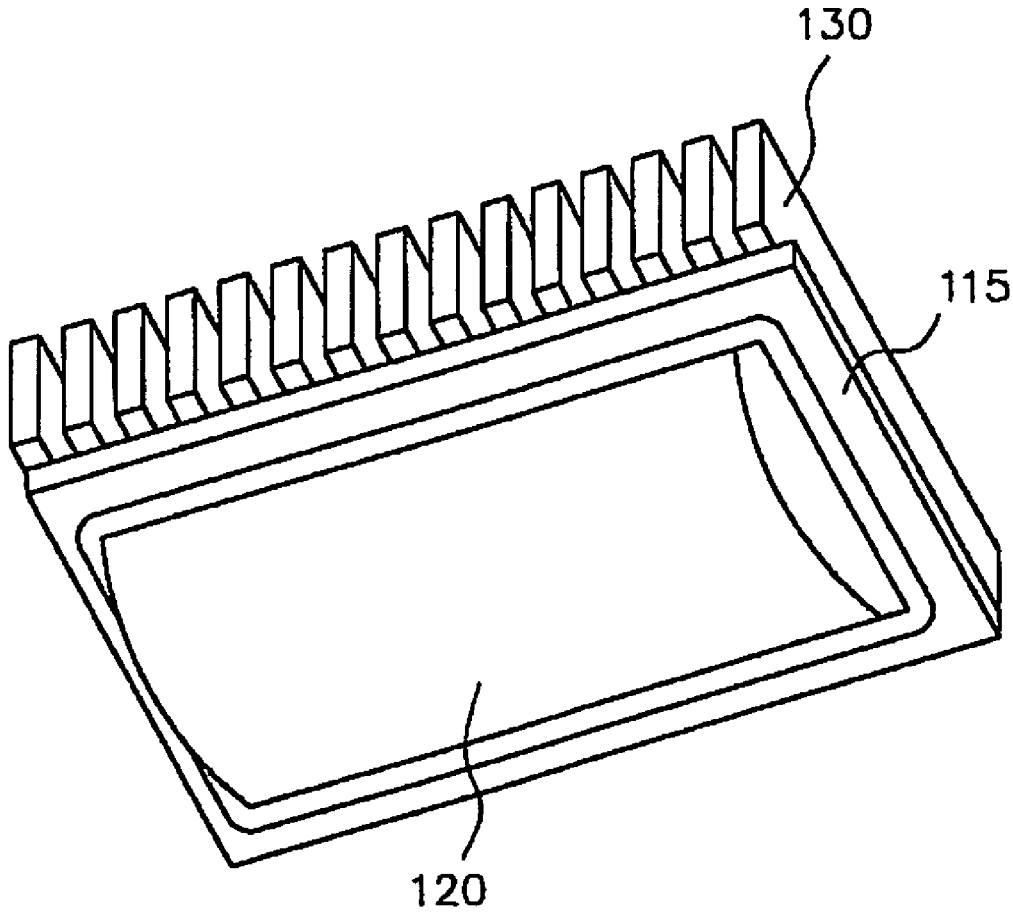
FIG. 2 (prior art)
FIG. 2 is a bottom view of a conventional light source module.
Figure 3:
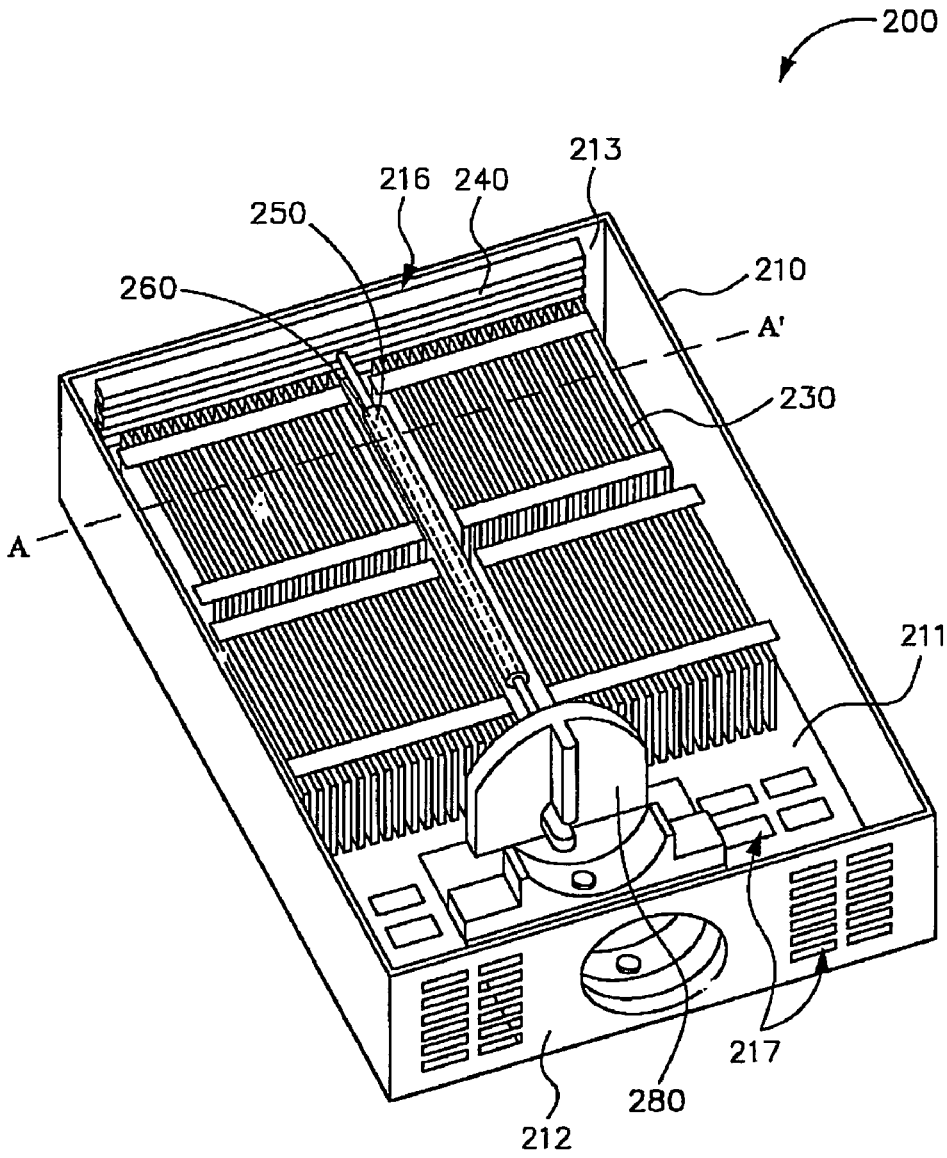
FIG. 3 is a three dimensional view of an illumination apparatus according to an embodiment of the invention.

Please refer to FIG. 3, an illumination apparatus 200 includes a heat dissipation apparatus having a housing 210, a light source module (not shown), a plurality of heat sink fins 230, a shutter structure 240, and a variable element 250.

The housing has a bottom 211, an outlet 216, and a plurality of inlets 217. The outlet 216 is disposed at one side 213 of the bottom 211 of the housing 210, and the inlets 217 is disposed at another side 212 of the bottom 211 of the housing 210 opposite to the outlet 216. In one embodiment, the bottom 211 is a heat dissipation surface of the housing 210. The illumination apparatus 200 further includes a lamp rod fixing base 280, and the lamp rod fixing base 280 is used to fix the illumination apparatus 200 on a lamp rod.

Figure 4:
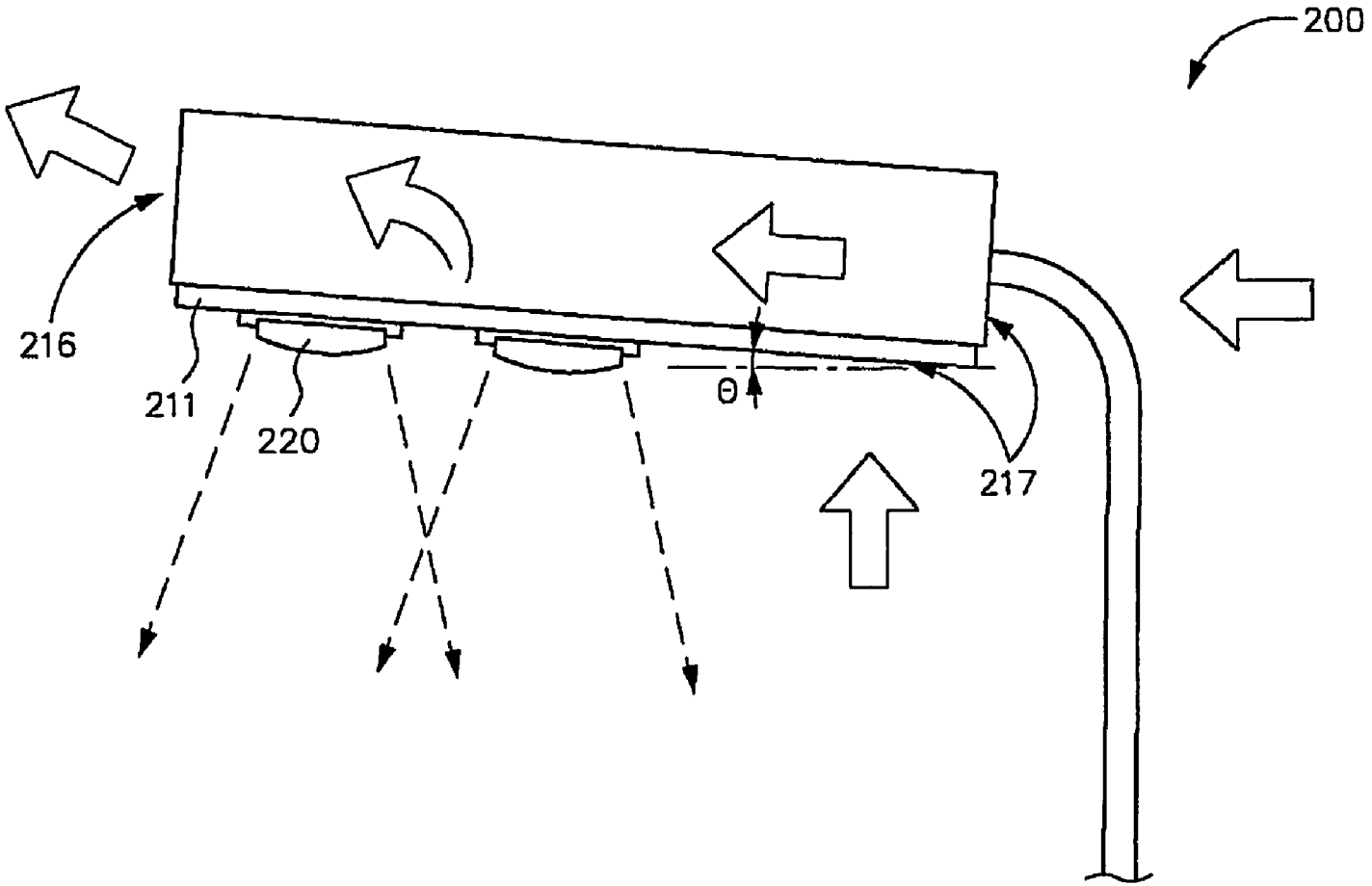
FIG. 4 is a side view of an illumination apparatus used in outdoors according to an embodiment of the invention.

Please refer to FIG. 4, the light source module 220 is a light emitting diode (LED) apparatus for example. The light source module 220 is disposed on the bottom 211 and provides a light beam and heat. The illumination apparatus 200 is disposed beside the street and has an elevation angle θ. As the illumination apparatus 200 is used to emit the light beam from both sides of the street to the center, as shown by the dotted lines in FIG. 4, the elevation angle θ makes the light beam provided by the light source 220 emit to the center of the street.

In the embodiment, the illumination apparatus 200 is capable of dissipating heat by adopting natural convection method. The principle of the natural convection is that the air is heated, the density of the air is reduced, and the air generates buoyancy effect, the air flowing direction is shown as the arrow in drawing, so the position of the outlet 216 is higher than the position of the inlet 217. Through the illumination apparatus 200 disposed in the elevation angle θ, the outlet 216 is disposed at high place, and the inlet 217 is disposed at low place to facilitate the operation of the natural convection air and to dissipate the heat from the light source module 220 stored in the housing 210. The range of the elevation angle θ of the illumination apparatus 200 is between 10 degrees and 20 degrees.

Please refer to FIG. 3 again, a plurality of heat sink fins 230 are disposed on another surface of the bottom 211 opposite to the light source module 220 and in the housing 210. The heat sink fins 230 are thermal conductivity connected to the light source module 220 to dissipate the heat of the light source module 220 and to avoid the heat stored in the housing 210 and result in too high temperature to damage the light source module 200. The heat generated by the light source module 220 located on the bottom surface of the bottom 211 conducts to the heat sink fins 230 located on the top surface of the bottom 211. The heat is carried from the inner of the housing 210 of the illumination apparatus 200, through the outlet 216, to the outside of the housing 210 of the illumination apparatus 200 by the air circulation of the natural convection, so as to speed up the discharge of the heat stored in the housing 210 and make the place between the heat sink fins 230 have an environment temperature.

Figure 5:
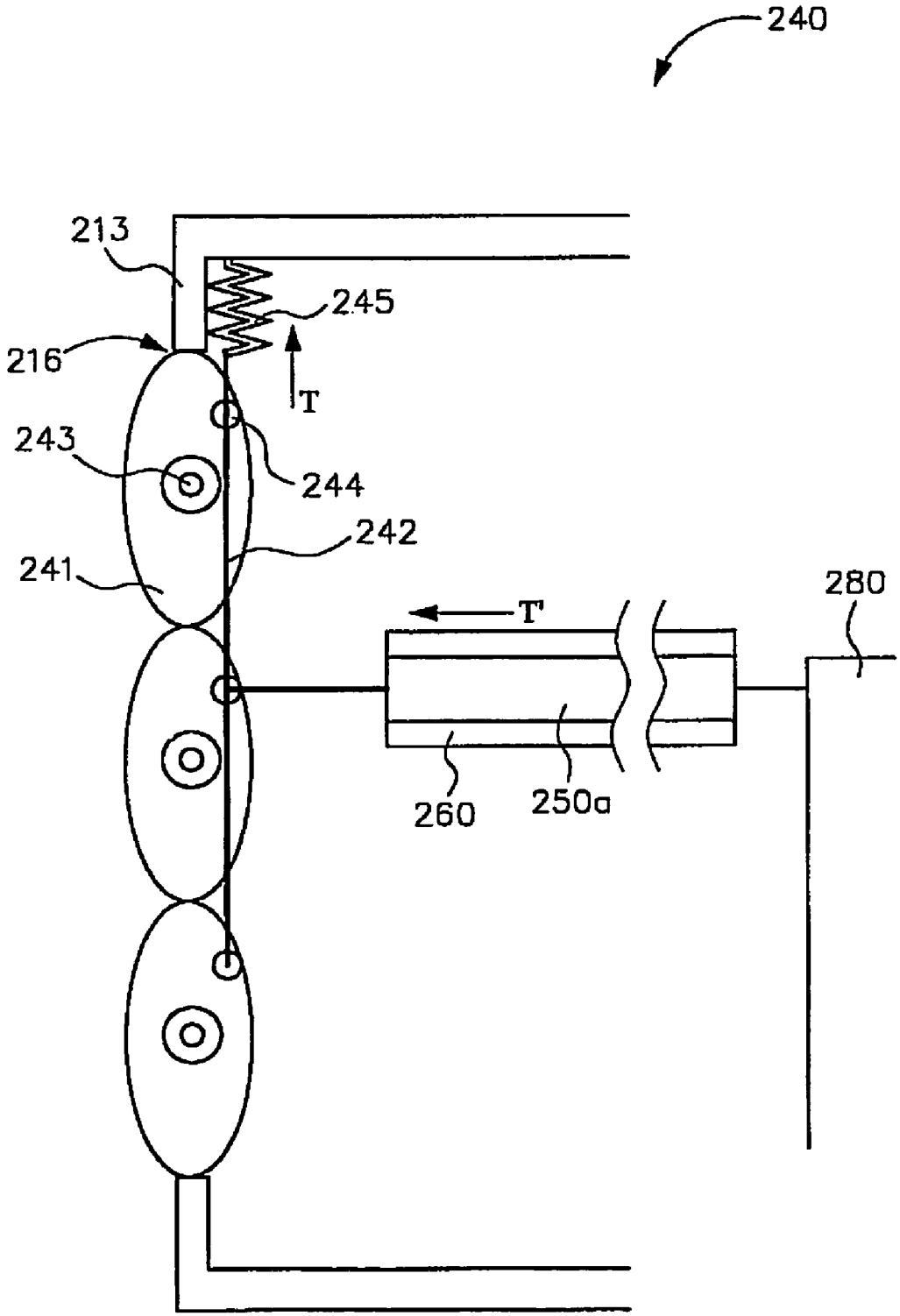
FIGS. 5 and 6 are an enlarged side view of a shutter structure and the operation of a variable element according to an embodiment of the invention.
Figure 6:
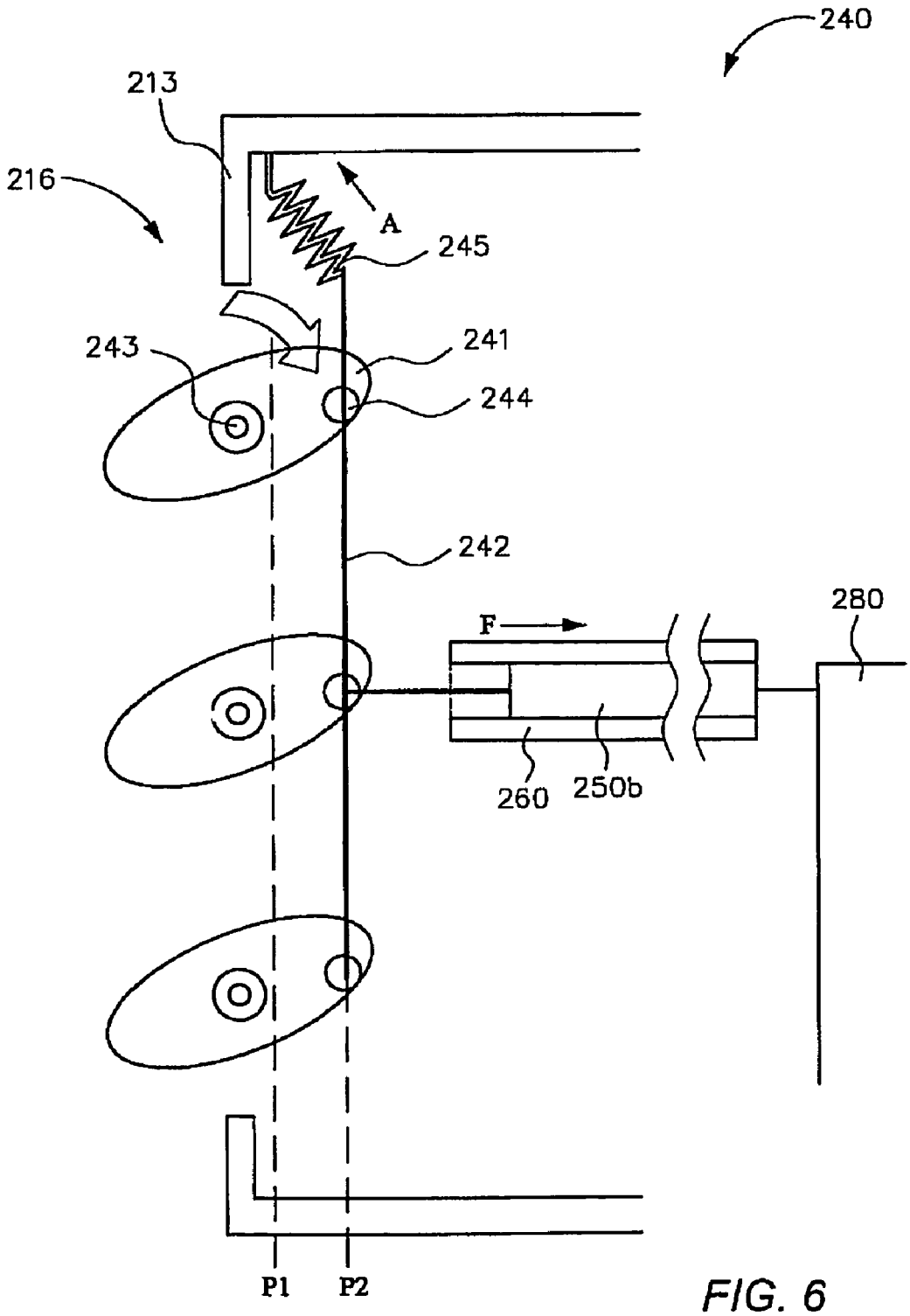

Please refer to FIGS. 3, 5 and 6, the shutter structure 240 is disposed on the outlet 216 of one side 213 of the housing 210 and includes a plurality of guiding plates 241, a connecting rod 242, and an operating element 245.

Each of the guiding plates 241 has a rotating shaft 243 and a connecting point 244. The connecting points 244 are respectively connected to connecting rod 242. The operating element 245 is disposed at one end of the connecting rod 242 and provides an operating force for the connecting rod 242, wherein the operating element 245 is an elastic spring, and the operating force is spring force T.

The variable element 250 is near the heat sink fins 230 and disposed between the heat dissipation fins 230. One end of the variable element 250 is connected to the connecting rod 242, and the other end is fixed on the lamp rod fixing base 280. However, in other embodiments, the other end of the variable element 250 may be connected to another substrate of the housing 210 or is fixed on the support element 260. The material of the variable element 250 is a shape memory alloy module, for example the alloy mixed with nickel and titanium, also called Nitinol. The shape memory alloy module has memory effect, mechanical properties, antifatigue, and corrosion resistance, and may endure great tension and press. The shape of the variable element 250 includes a circular cylinder, a rectangular cylinder, a triangular cylinder or a spiral.

In one embodiment, the illumination apparatus 250 further includes a support 260. The shape the support 260 is a pipe. The support 260 surrounds the variable element 250 to limit the shape variation of the variable element 250, wherein the material of the support 260 includes high thermal conductivity to conduct the heat generated by the light source module 220 to the variable element 250.

As shown in FIG. 5, when the variable element 250 is at normal temperature, the variable element 250 may have deformation and have a free shape. When the temperature rises to a certain temperature from the normal temperature, the variable element 250 is affected by the certain temperature and produces a deformation force F to make the variable element 250 return to the original shape. As shown in FIG. 6, the free form variable element 250*a* described by dotted line changes to an original form variable element 250*b* described by full line. The deformation principle of the variable element 250 belongs to a phase transformation of the metal solid state.

When the light source module 220 turns off, the environmental temperature between the heat dissipation fins 230 in the housing 210 is at a normal temperature and the environmental temperature is lower than the certain temperature. As shown in FIG. 5, the direction of the elastic force T of the elastic spring 245 is shown as the arrow. The elastic force T drives the connecting rod 242 and exerts a tensile force T' on the free form variable element 250*a* to make the shape of the free form variable element 250 deform as a result of the tensile force T', and the guiding plates 241 of the shutter structure 240 are driven by the elastic force T and make each of the guiding plates 241 rotate around the spindle 243 and shield the outlet 216, to prevent the dust or other foreign material entering the inner of the housing 210 from the outlet 216 and block up the gap between the heat dissipation fins 230, to avoid bad heat dissipation effect of the illumination apparatus 200 and damage the light source module 220.

When the light source module 220 turns on or the illumination apparatus 200 is illuminated intensively by the sun and at high temperature, the environmental temperature between the heat sink fins 230 in the housing 210 is higher than the normal temperature, and the environmental temperature is higher than the certain temperature. As shown in FIG. 6, the free form variable element 250*a* generates a deformation force F as a result of the affection of the certain temperature (that is being heated), and returns to the original form variable element 250*b* by the deformation force F. The operating direction of the elastic spring 245 is shown as the arrow. The elastic spring 245 tries pulling the connecting rod 242 to the original first position P1. However, the deformation force F drives the connecting rod 242 from the first position P1 to the second position P2 and makes each of the guiding plates 241 rotate around the spindle 243, as shown by arrow, to make the guiding plates 241 of the shutter structure 240 show the outlet 216 to facilitate the heat stored in the housing 210 to dissipate from the outlet 216 by adopting natural convection method.

Figure 7:
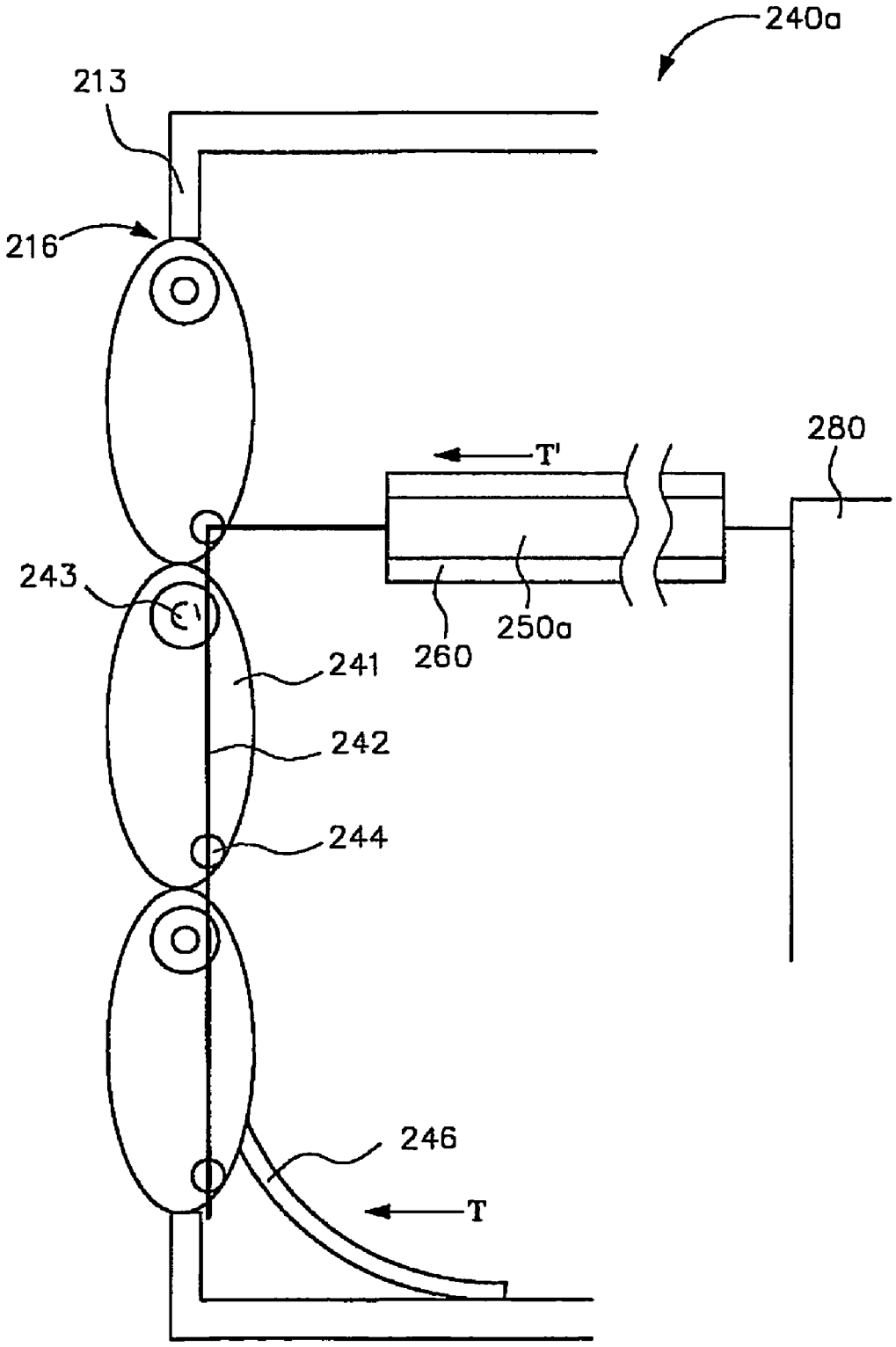
FIGS. 7 and 8 are an enlarged side view of a shutter structure and the operation of a variable element according to an embodiment of the invention.
Figure 8:
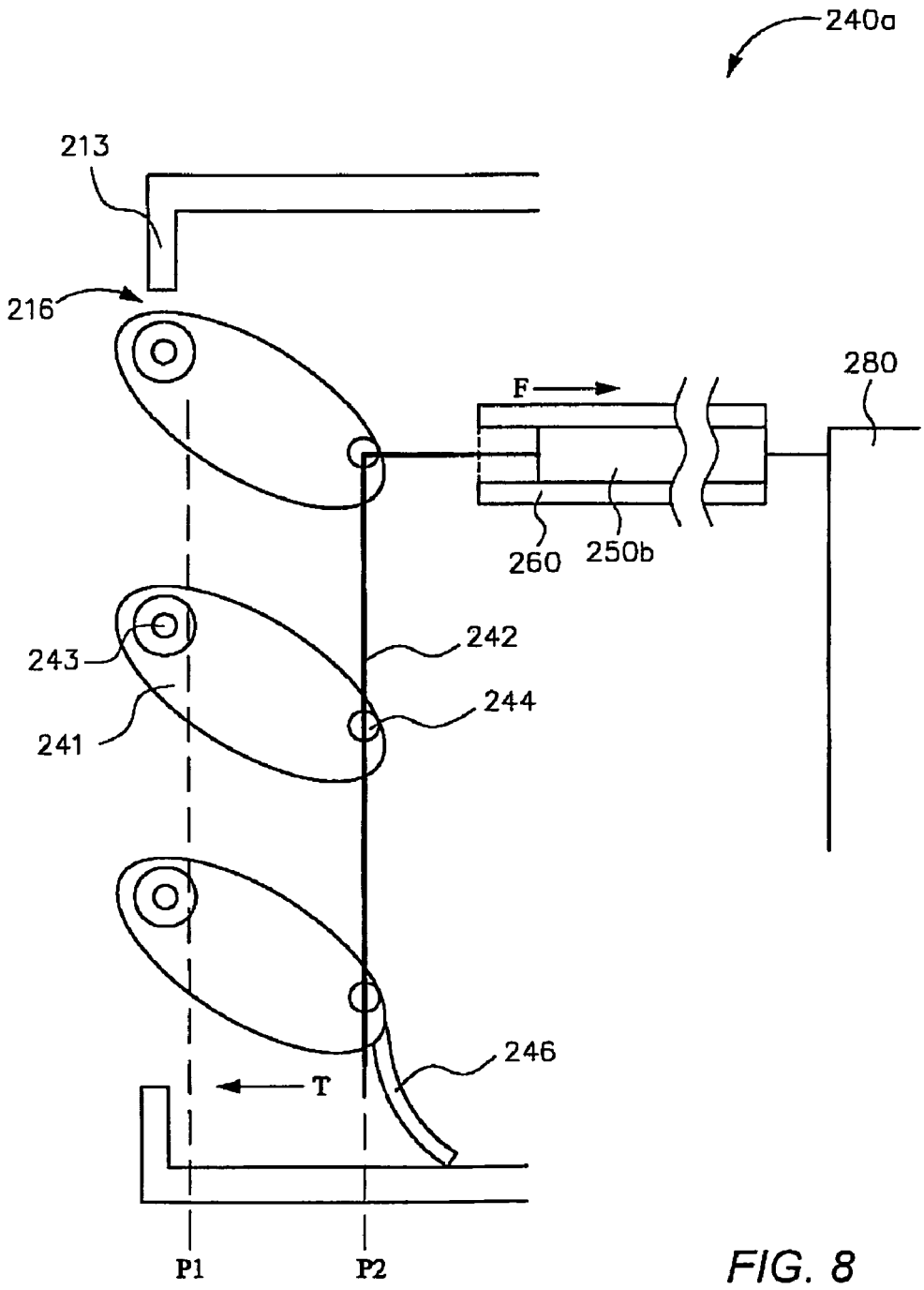

In one embodiment, the operating element 245 is changed to a resilient sheet 246, and the operating force is the elastic force T. As shown in FIGS. 7 and 8, the operating principle of the shutter structure 240*a* and the variable elements 250*a* and 250*b* are the same as the operating principle of the shutter structure 240 and the variable elements 250*a* and 250*b* in FIGS. 5 and 6.

In one embodiment, the operating element 245 is changed to a counterweight block 247, and the operating force is the gravity force W.

Figure 9:
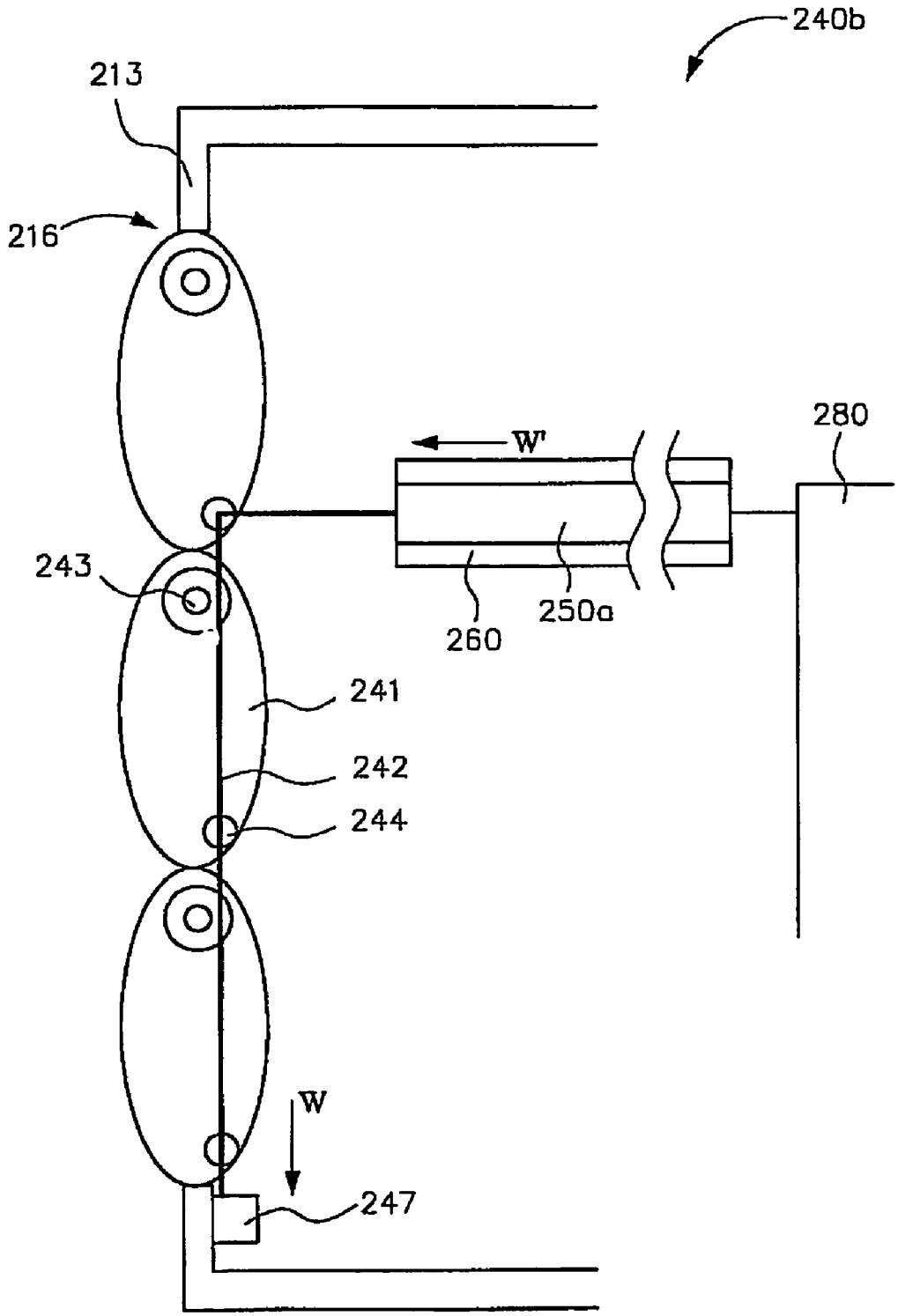
FIGS. 9 and 10 are an enlarged side view of a shutter structure and the operation of a variable element according to an embodiment of the invention.

When the light source module 220 turns off, the environmental temperature between the heat dissipation fins 230 in the housing 210 is at a normal temperature, and the environmental temperature is lower than the certain temperature. As shown in FIG. 9, the direction of the gravity force W of the counterweight block 247 is shown as the arrow. The gravity force T drives the connecting rod 242 and exerts a tensile force W' on the free form variable element 250*a*, to make the shape of the free form variable element 250 deform as a result of the tensile force W', and the guiding plates 241 of the shutter structure 240*b* are driven by the gravity force W and make each of the guiding plates 241 rotate around the spindle 243 and shield the outlet 216, to prevent the dust or other foreign material entering the inner of the housing 210 from the outlet 216.

Figure 10:
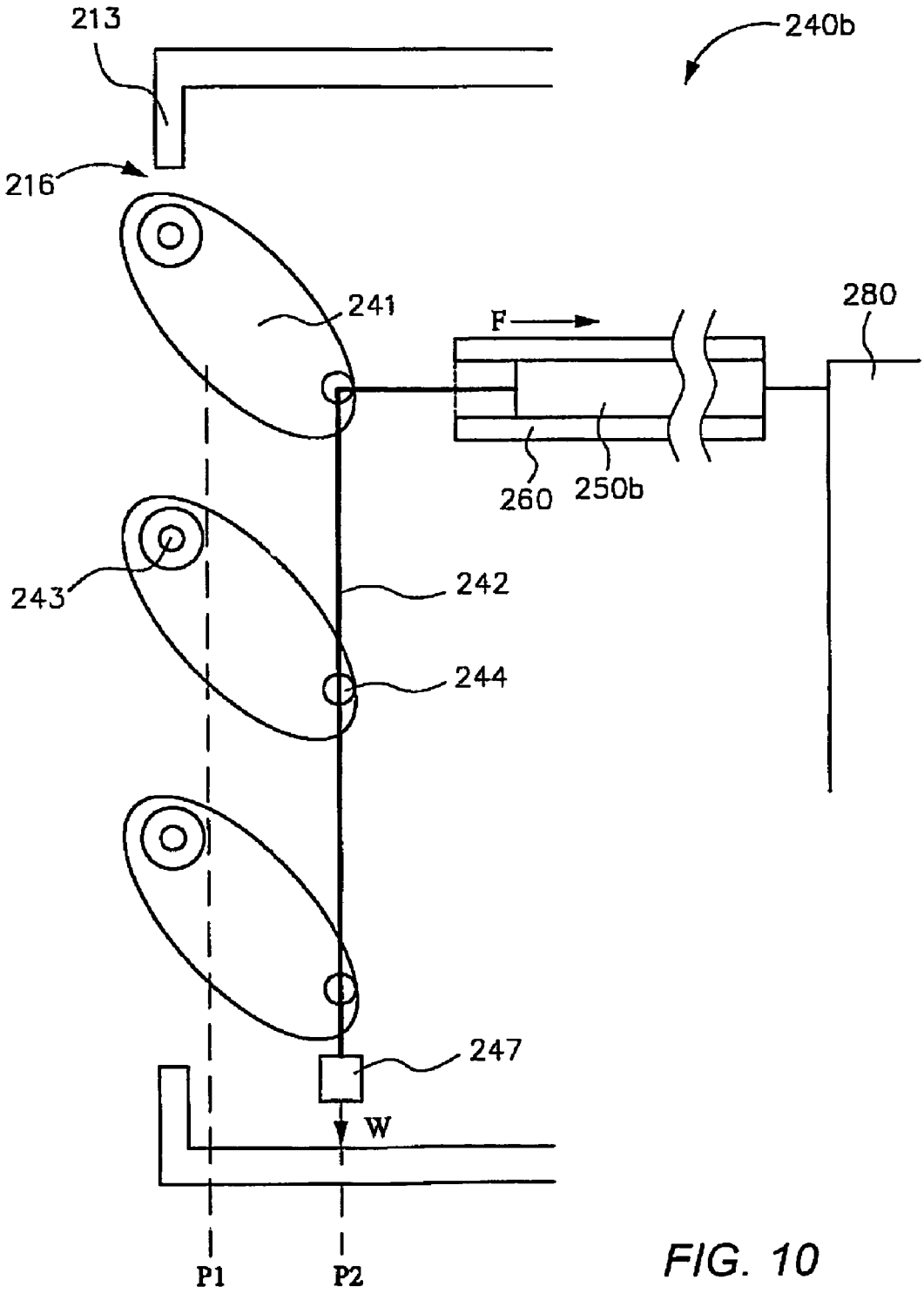

When the light source module 220 turns on or the illumination apparatus 200 is illuminated intensively by the sun and at high temperature, the environmental temperature between the heat sink fins 230 in the housing 210 is higher than the normal temperature, and the environmental temperature is higher than the certain temperature. As shown in FIG. 10, the free form variable element 250*a* generates a deformation force F as a result of the affection of the certain temperature, and returns to the original form variable element 250*b* by the deformation force F. The direction of the gravity force W is shown as the arrow. The gravity force W tries pulling the connecting rod 242 to the original first position P1. However, the deformation force F is greater than the gravity force W, so the deformation force F drives the connecting rod 242 from the first position P1 to the second position P2 and makes each of the guiding plates 241 rotate around the spindle 243, to make the guiding plates 241 of the shutter structure 240 show the outlet 216 to facilitate the heat stored in the housing 210 to dissipate from the outlet 216 by adopting natural convection method.

Figure 11:
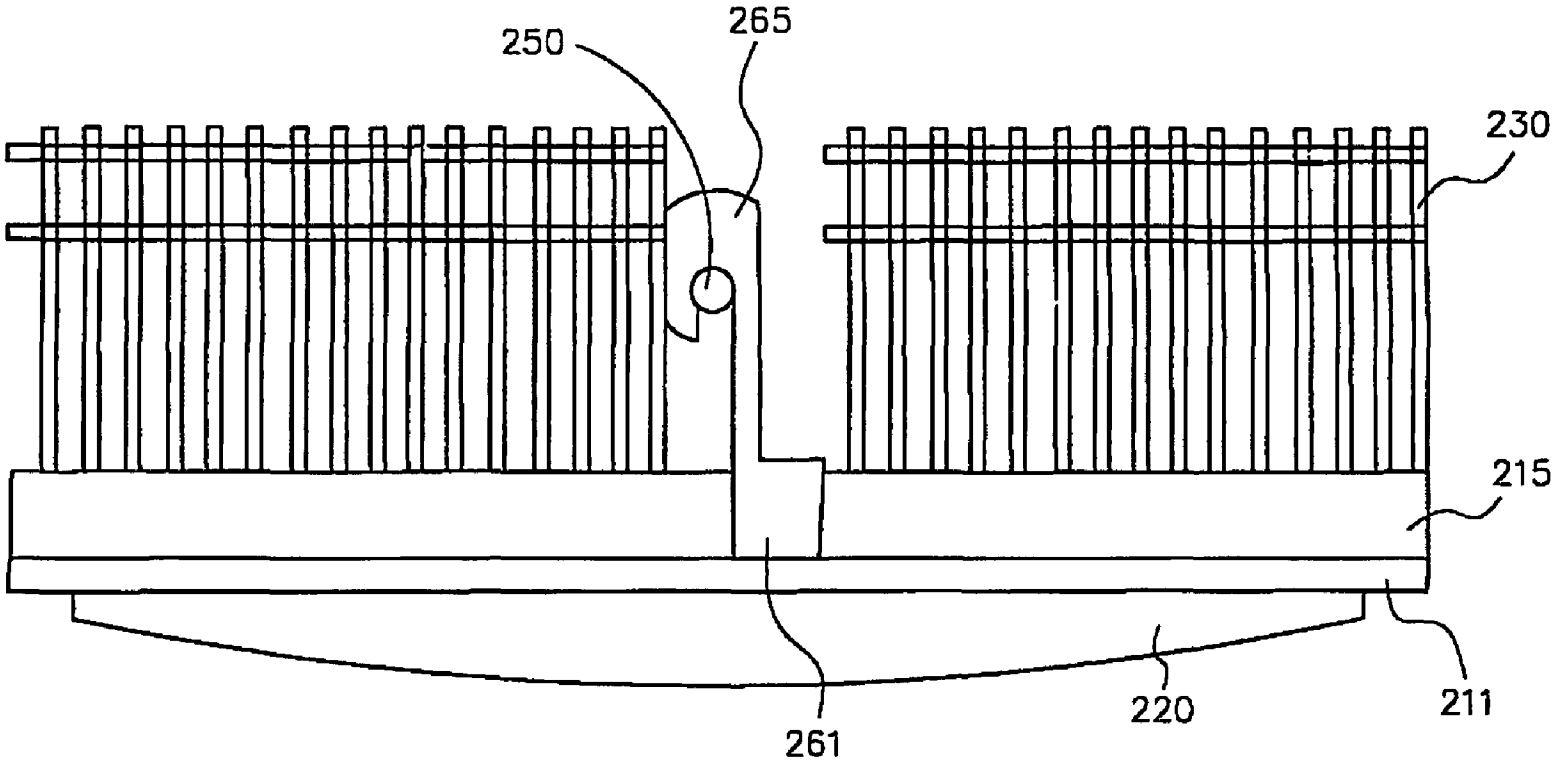
FIG. 11 is a cross-sectional view of the illumination apparatus in FIG. 3 along line A-A.

One embodiment of the invention further includes a heat dissipation plate 215 and a support 216, and the support 216 may substitute the pipe shaped support 260. As shown in FIG. 11, the heat dissipation plate 215 is thermal conductivity connected between the light source module 220 and the heat sink fins 230. One end of the support 261 is disposed on the bottom 211 and another end of the support 261 has a hook 265. The hook 265 surrounds the variable element 250 to limit the shape deformation of the variable element 250 and to avoid that the returning direction of the deformation force F may not drive the connecting rod 242. The material of the support 261 includes high thermal conductivity to conduct the heat dissipated by the light source module 220 to the variable element 250.

In summary, the embodiment or embodiments of the invention may have at least one of the following advantages.

a. By the arrangement of the variable element 250, the temperature in the housing 210 may selectively control the guiding plate 241 to shield the outlet 216, to make the illumination apparatus 200 have dust proof effect, and to make the opening of the outlet 216 be small or large to achieve heat dissipation effect.

b. The arrangement of the supports 260 and 261 is used to limit the shape deformation of the variable element 250 to determine the returning direction of the deformation force F, and to make the deformation force F drive the connecting rod 242 smoothly and rotate the guiding plate 241 to shield the outlet 216.

c. The number of the guiding plates 241 of the above-mentioned embodiments is more than one, the guiding plates 241 of the above-mentioned embodiments are used as an example only, and even only one guiding plate 241 in the shutter modules 240, 240*a*, and 240*b* may achieve the effect of the invention.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An illumination apparatus, comprising:

a housing, having a bottom and an outlet, the outlet disposed at one side of the bottom;

a light source module, disposed on the bottom of the housing;

a plurality of heat sink fins, disposed in the housing and thermal conductivity connected with the light source module;

a shutter structure, comprising a plurality of guiding plates, a connecting rod, and an operating element, the guiding plates disposed on the outlet, each of guiding plates being connected to the connecting rod, the operating element disposed at one end of the connecting rod and providing an operating force for the connecting rod; and a variable element, near the heat sink fins and connected with the connecting rod, wherein the variable element is deformed to exert a force on the connecting rod when the variable element is heated.

2. The illumination apparatus as claimed in claim 1, further comprising a support, the support surrounding the variable element and being in the shape of a pipe.

3. The illumination apparatus as claimed in claim 1, further comprising a support, one end of the support being disposed on the housing, another end of the support having a hook, and the hook surrounding the variable element.

4. The illumination apparatus as claimed in claim 2, wherein the material of the support comprises thermal conductivity.

5. The illumination apparatus as claimed in claim 3, wherein the material of the support comprises thermal conductivity.

6. The illumination apparatus as claimed in claim 1, further comprising a heat dissipation plate, the heat dissipation plate thermal conductivity connected between the heat sink fins and the light source module.

7. The illumination apparatus as claimed in claim 1, wherein the bottom is a heat dissipation surface of the housing.

8. The illumination apparatus as claimed in claim 1, wherein the shape of the variable element is selected from a group consisting of a circular cylinder, a rectangular cylinder, a triangular cylinder, and a spiral.

9. The illumination apparatus as claimed in claim 1, wherein the variable element is a shape memory alloy module.

10. The illumination apparatus as claimed in claim 1, wherein the operating element is one of an elastic spring and a resilient sheet.

11. The illumination apparatus as claimed in claim 1, wherein the operating element is a counterweight block.

12. The illumination apparatus as claimed in claim 1, wherein the housing further comprises a plurality of inlets, the inlets are disposed at one side of the bottom of the housing and opposite to the outlet.

13. A heat dissipation structure adapted to an illumination apparatus, the illumination apparatus having a housing, the housing providing an outlet, the heat dissipation structure comprising:

a plurality of guiding plates, disposed on the outlet;

a connecting rod, connected to each of the guiding plates;

an operating element, disposed at one end of the connecting rod and providing an operating force for the connecting rod;

a variable element, connected to another end of the connecting rod, the variable element is deformed to exert a force on the connecting rod when the variable element is heated; and a plurality of heat sink fins, disposed in the housing and near the variable element.

14. The heat dissipation structure as claimed in claim 13, further comprising a support, the support surrounding the variable element and being in the shape of a pipe.

15. The heat dissipation structure as claimed in claim 13, further comprising a support, one end of the support being disposed on the housing, another end of the support having a hook, and the hook surrounding the variable element.

16. The heat dissipation structure as claimed in claim 13, wherein the shape of variable element is selected from a group consisting of a circular cylinder, a rectangular cylinder, a triangular cylinder, and a spiral.

17. The heat dissipation structure as claimed in claim 13, wherein the variable element is a shape memory alloy module.

18. The heat dissipation structure as claimed in claim 13, wherein the operating element is one of an elastic spring and a resilient sheet.

19. The heat dissipation structure as claimed in claim 13, wherein the operating element is a counterweight block.

* * * * *